US005161617A

United States Patent [19]

Marschke

[11] Patent Number: 5,161,617

[45] Date of Patent: Nov. 10, 1992

[54] DIRECTLY INSTALLED SHUT-OFF AND DIVERTER VALVE ASSEMBLY FOR FLOWING OIL WELL WITH CONCENTRIC CASINGS

[75] Inventor: Carl R. Marschke, Phillips, Wis.

[73] Assignee: Marquip, Inc., Phillips, Wis.

[21] Appl. No.: 736,972

[22] Filed: Jul. 29, 1991

[51] Int. Cl.[5] ..... E21B 29/08; E21B 33/068; E21B 34/02

[52] U.S. Cl. ..... 166/298; 137/318; 166/55; 166/90; 166/95; 166/97; 166/379; 166/386

[58] Field of Search ..... 166/379, 373, 386, 298, 166/55, 95, 97, 90, 97.5; 137/15, 318

[56] References Cited

U.S. PATENT DOCUMENTS

| | | | |
|---|---|---|---|
| 1,851,894 | 3/1932 | Clough | 166/55 |
| 1,879,160 | 9/1932 | Fowzer . | |
| 2,000,381 | 5/1935 | Duffy | 166/90 |
| 2,766,830 | 10/1956 | Church | 166/95 X |
| 2,840,166 | 6/1958 | Eckel et al. | 166/55 |
| 3,170,226 | 2/1965 | Larry | 29/157 |
| 3,277,964 | 10/1966 | Houpeurt et al. | 166/90 X |
| 3,532,113 | 10/1970 | McKean | 137/318 |
| 3,603,387 | 9/1971 | Schoeffler | 166/55 |
| 3,693,715 | 9/1972 | Brown | 166/55 |
| 3,699,996 | 10/1972 | Nichols | 137/318 |
| 3,717,202 | 2/1973 | Burrow | 166/55 |
| 3,738,424 | 6/1973 | Osmun et al. | 166/298 |
| 3,867,964 | 2/1975 | Gardner | 166/55 X |
| 3,993,137 | 11/1976 | Hefetz | 169/46 |
| 4,108,194 | 8/1978 | Harrison et al. | 137/15 |
| 4,369,845 | 1/1983 | Henson et al. | 166/379 X |
| 4,516,598 | 5/1985 | Stupak | 137/318 |
| 4,552,170 | 11/1985 | Margrave | 137/318 |
| 5,076,311 | 12/1991 | Marschke | 137/15 |

*Primary Examiner*—Hoang C. Dang
*Attorney, Agent, or Firm*—Andrus, Sceales, Starke & Sawall

[57] ABSTRACT

An apparatus for installing a selectively reopenable shut-off valve into an oil well casing of the type having an outer production casing and an inner production pipe suspended therein including a laterally installed casing plug to which independent flow diversion apparatus are attached after the casing is plugged and flow is initially stopped to allow temporary diversion and continued separated and independent flow from the annulus between the outer casing and inner pipe and from the pipe itself. The apparatus is particularly adapted to shut off a well which is burning or flowing out of control so that suitable repairs may be effected at the wellhead, while production is continued via the separately diverted flows.

7 Claims, 4 Drawing Sheets

FIG. 1
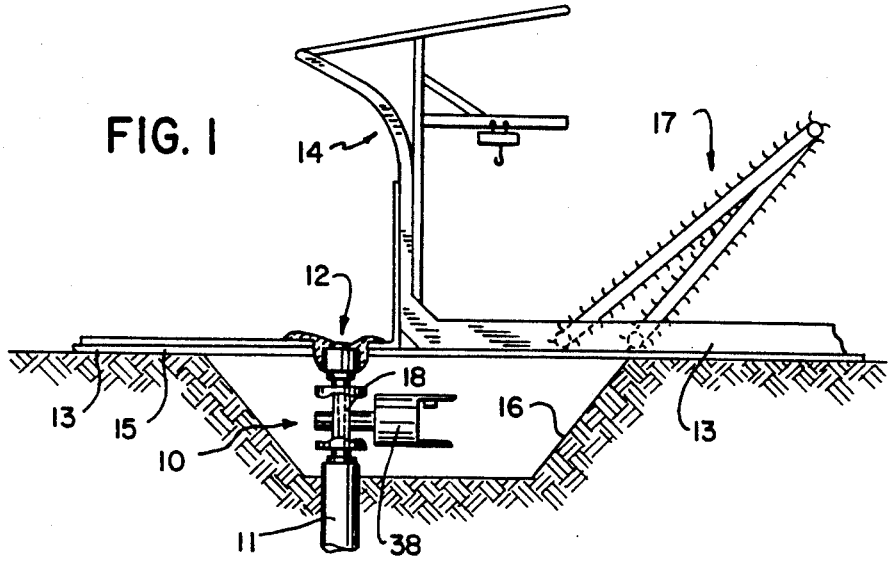
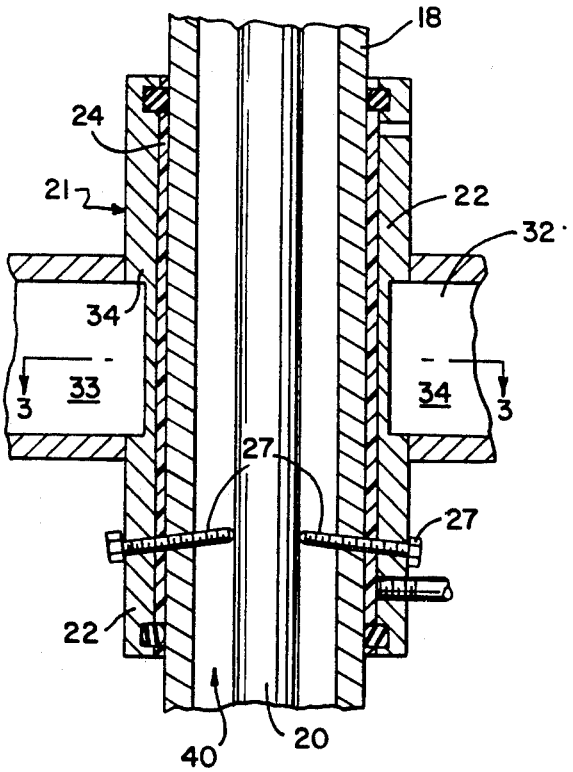
FIG. 2
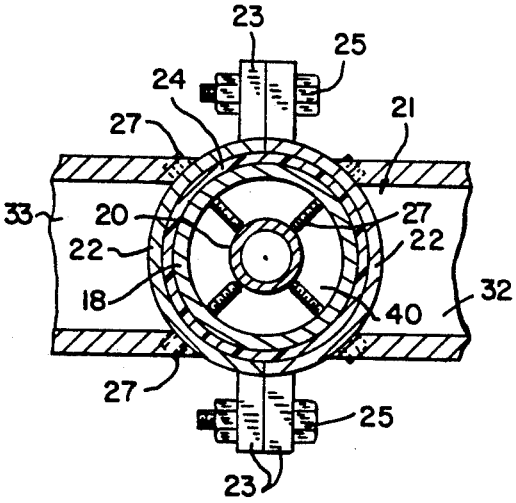
FIG. 3

DIRECTLY INSTALLED SHUT-OFF AND DIVERTER VALVE ASSEMBLY FOR FLOWING OIL WELL WITH CONCENTRIC CASINGS

BACKGROUND OF THE INVENTION

The present invention relates to an apparatus and method for directly installing a shut-off valve in a flowing oil well casing and, more particularly, to such an apparatus and method for shutting off a flowing oil well having concentric production casings and subsequently selectively and separately reopening each of said casings to recommence their respective flows.

Apparatus and methods for handling oil well blow-outs and fires are well known in the art. One of the most common devices used to control a well is a blow-out preventer (BOP). A BOP or an array of BOPs are attached directly to the wellhead and operate to rapidly close an open well hole or the space between the casing and the drill pipe to prevent the escape of pressurized oil or gas. These devices work essentially as plugs and may be either insertable laterally into the casing (ram type BOP) or expandable radially to fill the casing (annular BOP). On a land well, the BOP is normally located at the ground surface and, in a subsea well, at the ocean floor.

Although blow-out preventers are effective in preventing blow-outs and ensuing fires, if the wellhead is damaged or if a fire occurs before the blow-out preventers operate to seal the well, BOPs may become largely ineffective. Once a well is out of control or on fire, resort must be made to other means to bring the well under control.

Various types of relatively unsophisticated, brute force methods are employed to control wild wells, including those which may be on fire. All of these methods operate essentially directly at the wellhead to attempt to cap and seal it off. Obviously, if the well is afire, greater difficulty and hazards must be faced.

U.S. Pat. No. 1,879,160 discloses a method and apparatus for shutting off a burning oil well by plugging the same from an access point below ground. The apparatus inserts a wedge-like plug laterally through a hole drilled in the production pipe (and outer casing, if present) to plug the pipe and seal off the flow. Mud and cement are then pumped into the pipe through the plug to seal off the well. This method and apparatus contemplates permanent sealing of the well and taking the same completely out of production.

The prior art also discloses various types of apparatus for installing a plug in a flowing high pressure pipeline which plug can be subsequently withdrawn and reseated as a fully operative valve. Each of these patents utilizes means to cut a hole through or cut a section out of the flowing pipeline while withstanding the pressure therein and then permanently placing the valve in position.

U.S. Pat. No. 3,699,996 shows an apparatus including a drilling and reaming tool to cut a cylindrical hole through the flowing pipeline using a powered rotational drive and an axial hydraulic ram. A valve seat and valve plug are mounted axially behind the drill and the seat automatically snaps into position upon completion of the drilling and the drill bit can be subsequently removed from the valve plug. This apparatus requires complex sealing and locking components and requires that the drill bit be removed from the seat/plug assembly before the valve is operable.

U.S. Pat. No. 3,532,113 shows a combined cutting tool and gate valve which is used to cut a cylindrical hole laterally through the pipe and to close off the hole after cutting. The drill/gate may be subsequently withdrawn to open the valve, but the apparatus requires a complex variety of seals and packings to maintain a fluid tight valve.

U.S Pat. No. 4,552,170 shows a somewhat similar device, except that the drill which cuts a cylindrical hole through the pipe is followed axially by a tubular elastomeric seal which is radially expandable to seal the hole in response to axial compression imposed on the elastomer when the advancing cutting tool engages a stop after passing through the pipe.

U.S. Pat. No. 3,993,137 discloses an apparatus in which axially aligned and diametrically opposite drill and plug members are mounted in a confining saddle arrangement around an outer casing, and the interior pipe is immobilized by drills entering the pipe radially from different directions. A large drill is then used to cut through both the casing and the interior pipe, the drill is withdrawn, the drill access chamber closed, and a plug inserted from the diametrically opposite side to seal the casing. The plug is also capable of functioning as a valve. Means are also disclosed for maintaining operational flow of the well while it is plugged by diverting the flow through the plug. However, the two separate flows in the outer casing and interior pipe are mixed and cannot be separately diverted.

U.S. Pat. No. 4,516,598 also discloses a drill and a plug in axial alignment on diametrically opposite sides of the pipe. However, after a hole is drilled through the pipe, the drill is withdrawn, the mounting saddle rotated 180°, and the plug inserted into the hole to plug the pipe.

U.S. Pat. No. 4,108,194 shows a method and apparatus for providing a tapered pipeline seal in which a straight cylindrical hole is first drilled through the pipe and the cylindrical hole is then reamed to a taper adapted to receive a subsequently inserted tapered plug to seal the hole. However, no means are described for holding against pressure in a flowing pipe while drilling, reaming, or changing tools. The apparatus and method are only useful in plugging an empty pipeline.

Therefore, an apparatus and method which operates simply and effectively to seal off a flowing high pressure pipeline with a minimum of complex components would be most desirable. In particular, a device which utilizes the drilling and/or finishing tool as an integral part of the operating valve would be most desirable. In those well constructions utilizing an outer production casing and a smaller concentric interior production pipe, it would be most desirable to be able to plug the casing to halt flow of well fluids through both the casing and the pipe, but to be able to subsequently independently reopen the casing and the pipe and to separately divert the fluids flowing therein.

U.S. patent application Ser. No. 697,398, filed May 9, 1991, entitled "Directly Installed Shut-Off Valve Assembly for Flowing High Pressure Line", now the U.S. Pat. No. 5,076,311, and of common inventorship herewith discloses an apparatus for cutting into a flowing high pressure oil well casing using rotary drilling and finishing tools with the latter functioning in place as a plug and fully operable valve to subsequently reopen the well. The apparatus and method disclosed therein may be installed without adversely affecting the integrity of the production casing or subsequent operation of the well. However, that application does not address the problem of selectively reopening and separately diverting the fluid flows from each of the production casing and production pipe. In many wells, the fluids flowing in the production casing and the production pipe are somewhat or even completely different and, under normal operating conditions, the flows are maintained entirely separate. Therefore, it would be most desirable to be able to utilize the temporary plugging and valve means of the prior art to segregate the flows in the production casing and pipe to allow the well to function fully and effectively while plugged and while repairs to the wellhead are completed.

SUMMARY OF THE INVENTION

In accordance With the present invention, an apparatus is disclosed for selectively reopening an oil well of the type which has an outer production casing and an inner production pipe suspended inside the outer casing, both of which casings are carrying a flow of well fluids. The apparatus utilizes a split cylindrical sleeve for enclosing a section of the outer casing to retain the integrity thereof and to support the various devices for cutting through and plugging the casing and subsequently reopening the same.

Initially, appropriate means are attached to the sleeve which are extendible through the outer casing to engage, position and hold the inner pipe coaxially within the outer casing. Means for cutting a diametral hole through the outer casing are operatively attached to the cylindrical sleeve for movement through the sleeve to cut a hole having a diameter at least as large as the inner diameter of the outer casing and for severing the inner pipe. Plug means having an outer surface conforming to the size and shape of the hole cut in the outer casing is adapted to be inserted into the hole to completely block the flows from the outer casing and the inner pipe.

A first fluid inlet is provided in the outer surface of the plug means in alignment and fluid communication with the annulus formed between the inside of the outer casing and the outside of the inner pipe. First fluid flow control means is operatively attached to the plug means for directing the fluid flowing into the first inlet from the annulus through the plug means and sleeve in a direction generally axially of the hole cut through the casing.

An initially plugged second fluid inlet is formed in the outer surface of the plug means and aligned axially with the severed end of the inner pipe below the plug means. The second fluid inlet extends through the plug generally on the diameter thereof. Second fluid flow control means operatively interconnects the second fluid inlet and the severed inner pipe and is operable to open the plugged inlet and direct fluid from the inner pipe through the plug.

The first and second fluid flow control means are independently operable so that the production casing and the production pipe may be selectively reopened and the fluids flowing therein maintained completely separate.

BRIEF DESCRIPTION OF THE DRAWINGS

FIG. 1 is a side elevation partly in section providing a generally schematic representation of the device used to prepare the site and access the oil well casing for application of the apparatus of the present invention.

FIG. 2 is a vertical section through a portion of a well casing showing preliminary attachment of the enclosing saddle.

FIG. 3 is a horizontal section taken on line 3—3 of FIG. 2.

DETAILED DESCRIPTION OF THE PREFERRED EMBODIMENTS

Figure 4:
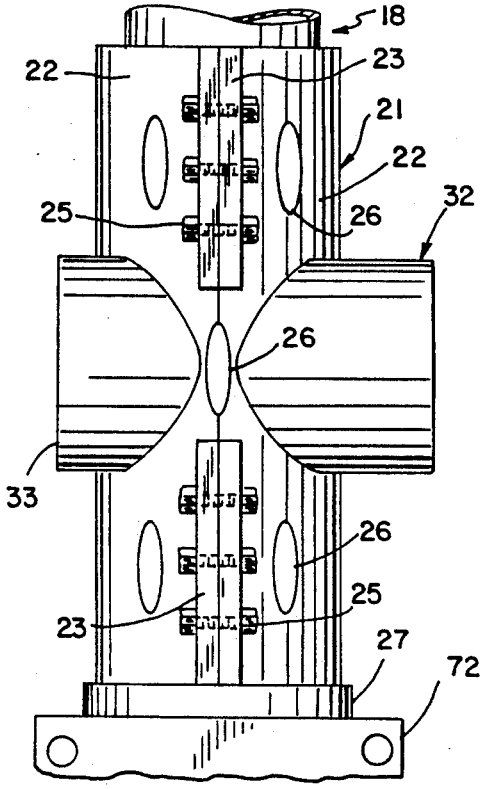
FIG. 4 is an elevation view of the casing-enclosing saddle showing a presently preferred manner of attaching the same.

The well plugging and reopening apparatus 10 of the present invention is shown schematically in FIG. 1 in its operative position attached to the production casing of an oil well which is normally enclosed in a main outer casing 11. In FIG. 1, the plugging apparatus 10 has been installed and the fire at the wellhead 12 has been extinguished. To provide access for attaching the plugging and reopening apparatus 10, a sled-like carriage 13 is positioned over the wellhead and includes a generally vertical heat shield 14 to deflect the flames and oil from the burning well, and a horizontal shielding platform 15 which, with the rearward portion of the carriage 13, spans and provides a protective cover for an access cavity 16 excavated around the main outer casing 11. An excavating apparatus 17 mounted on the carriage 13 (and shown in its retracted inoperative position) is moved forwardly and downwardly to excavate the access cavity 16. The carriage and access apparatus is described in greater detail in copending and commonly assigned U.S. application Ser. No. 708,161, filed May 31, 1991. The subject matter of that application is incorporated by reference herein.

After the access cavity 16 has been excavated and the outer casing 11 exposed, the outer casing, lining material, and any intermediate casings are removed to expose the production casing 18 (shown in greater detail in FIGS. 2–5). Many wells also include an inner production pipe 20 having an OD substantially smaller than the ID of the production casing 18 and suspended therein. The production casing 18 and production pipe 20 may carry significantly different well fluids, including crude oil from different strata, water and other pumping fluids, gases and mixtures thereof. Thus, in normal production, the flows from the production pipe 20 and production casing 18 are segregated and separately controlled.

Referring particularly to FIGS. 2 and 3, the exposed production casing 18 is first enclosed in a reinforcing saddle 21 which retains the integrity of the casing after it is cut (as will be described) and provides support for the cutting, plugging and flow diversion apparatus. Reference is also made to copending and commonly owned application Ser. No. 697,398, now the U.S. Pat.

No. 5,076,311, identified above and incorporated herein by reference.

The saddle 21 is split and includes two semicylindrical halves 22, each of which includes integral mating bolting flanges 23. The saddle may be attached directly to the outside surface of the production casing 18 or may be separated therefrom with a layer of a hardenable sealing material 24, such as epoxy. In either case, the bolting flanges 23 are secured together with suitable flange bolts 25. Referring also to FIG. 4, the saddle halves 22 may also be plug welded to the casing 18. Weld slots 26 are suitably preformed in the saddle halves 22 and, after initial positioning of the saddle around the casing, the slots 26 are filled with weld material to secure the saddle directly to the casing. Plug welding may eliminate the necessity of forming full circumferential welds at the upper and lower interfaces between the saddle ends and the casing 18. Such circumferential welds may induce hydrogen embrittlement in the production casing 18 and are generally undesirable. Plug welds may be utilized where the saddle is attached directly to the casing or where it is spaced therefrom with a sealing epoxy layer 24.

In order to utilize the apparatus of the preferred embodiment of the present invention, the central production pipe 20 must be centered within the production casing and held securely in that position. To center the production pipe 20 coaxially within the production casing 18, a series of jack bolts 27 are inserted radially through the saddle 21, production casing 18 (and any intermediate epoxy layer 24) and into engagement with the outside surface of the production pipe 20. At least three jack bolts 27 are required and, in actual practice, preferably four equally circumferentially spaced bolts are utilized. For convenience, the jack bolts 27 are shown positioned in the plane of FIG. 2, and only two are shown. When using four bolts, they would preferably be located in positions approximately 45° rotationally from the bolt positions shown in FIG. 2 and as are correctly shown in FIG. 3. The jack bolts 27 are initially installed at a slightly upwardly inclined angle, as shown in FIG. 2, so that when the production pipe 20 is subsequently severed and the lower end thereof tends to drop vertically, the bolts will be better able to withstand the vertical load component, though they may deflect downwardly to a more horizontal position, as shown in FIG. 6.

Figure 5:
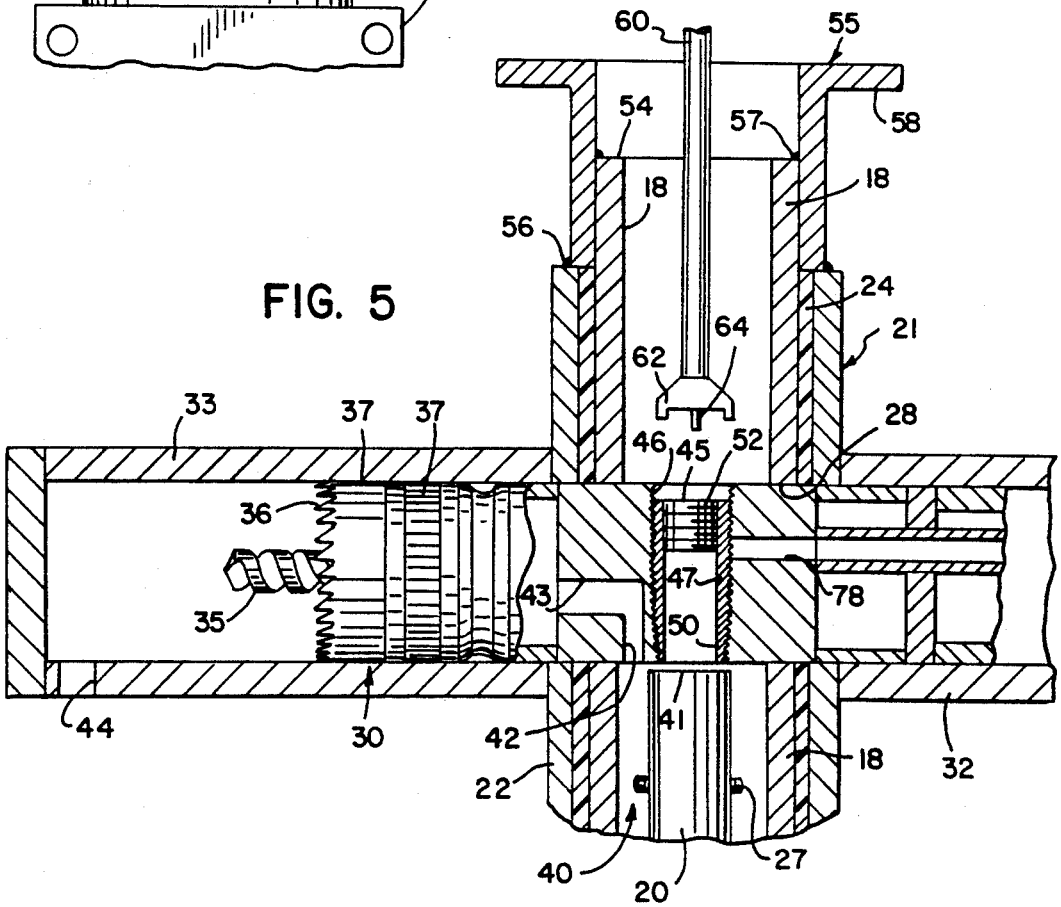
FIG. 5 is a sectional side elevation of a well casing which has been drilled and initially plugged with the apparatus of the present invention.

After the saddle 21 has been installed and the production pipe 20 centered and immobilized, a large hole 28 is cut laterally directly through the saddle and production casing 18 and severing the production pipe 20. The axis of the hole is directly coincident with the diameter of the concentric saddle and casing and is preferably just slightly larger than the ID of the production casing 18. Referring particularly to FIG. 5, and referring also to the more detailed description in the above identified copending application, the large hole 28 is cut and plugged by a combination drill 30 and casing plug 31 which are caused to pass through the saddle and casing from an access chamber 32 secured to one side of the saddle 21, with the drill received in a receiving chamber 33 attached to the saddle on the diametrically opposite side from the access chamber. The surfaces of the saddle halves 22 within the access and receiving chambers 32 and 33 are preferably precut to provide recessed areas 34 of substantially reduced cross section to facilitate drilling.

As shown in FIG. 5, the drill 30 may include a lead pilot drill 35 and circumferential cutting teeth 36, as well as following surface finishing tools 37. Attached to and following directly behind the drill 30 is the large generally cylindrical casing plug 31. A suitable operating mechanism 38 (FIG. 1) is mounted on the opposite end of the access chamber 32 and includes means for rotating the drill and plug and moving the same axially through the saddle and casing. As the drill 30 exits the far side of the saddle 21 and enters the receiving chamber 33, forward axial movement is halted to position the plug 31 centrally within the saddle and casing 18, completely blocking the flow of well fluids past the plug from the annulus 18 between the ID of the production casing 18 and the OD of the production pipe 20, and from the production pipe 20 itself, the latter having been severed by the drill and presenting a severed upper end 41 held immediately below the plug by the jack bolts 27.

Figure 6:
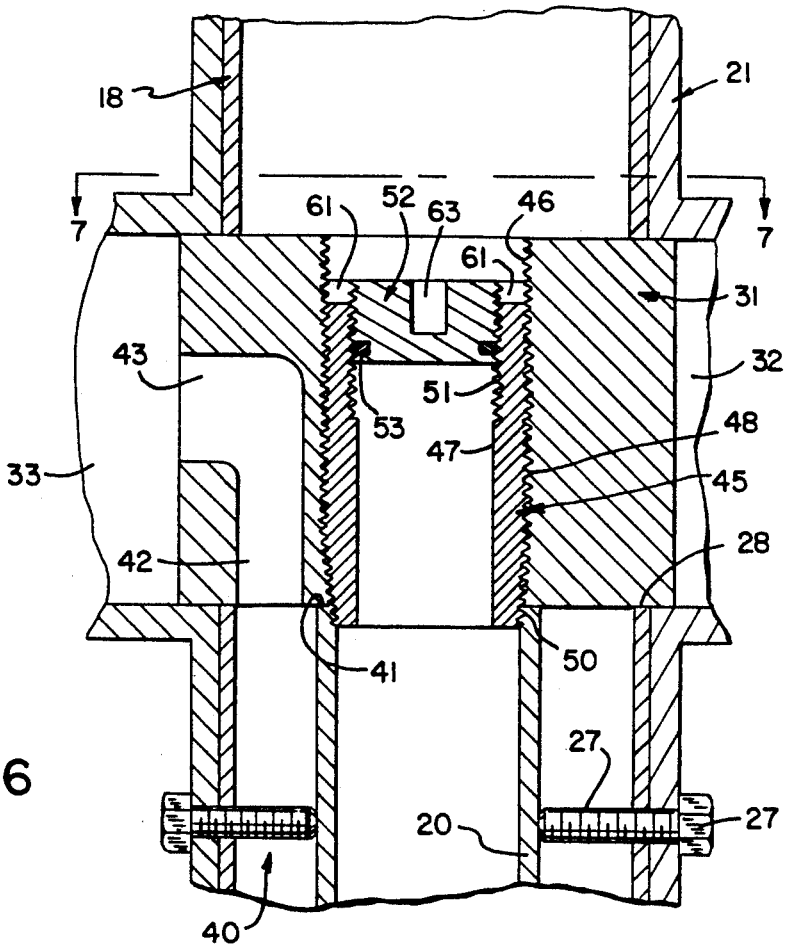
FIG. 6 is an enlarged vertical section of a portion of FIG. 5 showing details of the apparatus for separately and selectively reopening the well to flow from the outer casing and inner production pipe.
Figure 7:
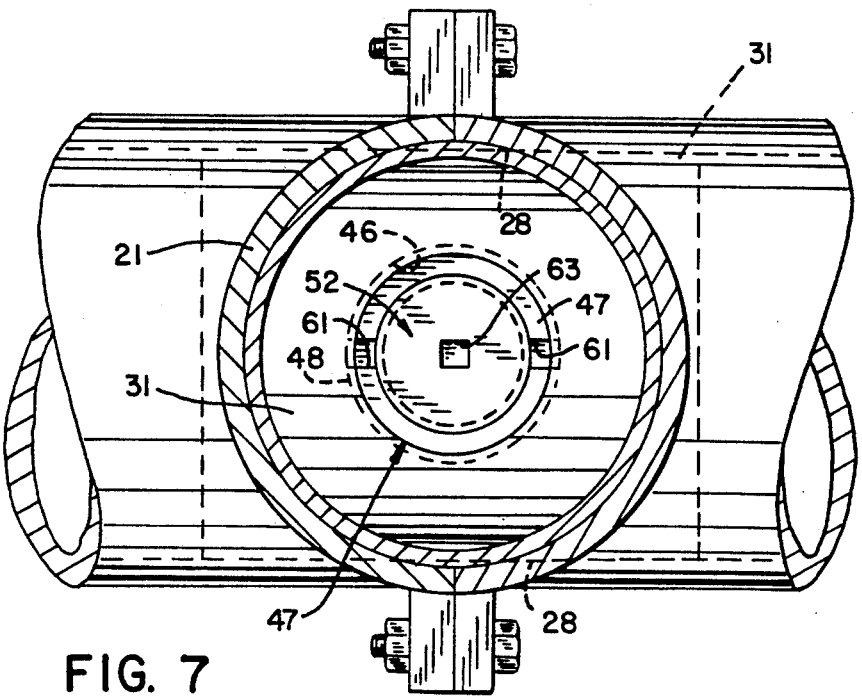
FIG. 7 is a horizontal section taken on line 7—7 of FIG. 6.

Referring also to FIGS. 6 and 7, the plug 31 includes a first fluid inlet 42 in the surface of the plug positioned to communicate directly with the annulus 40. The first inlet 42 defines the opening to a first fluid passage 43 which extends radially into the plug a short distance and then turns at a right angle to extend axially through the plug and drill 30 to an opening within the receiving chamber 33. An outlet passage 44 in the receiving chamber may be provided with a suitable valve and operator (not shown) to control the diversion of oil or other well fluid flowing from the annulus 40 after the casing has been initially plugged.

It is also desirable to separate the flow from the severed end 41 of the production pipe 20 and separately divert that flow until suitable repairs are made at the wellhead 12 and reconnection of the production casing and pipe may be effected. Until the flow from the severed production pipe 20 is sealed for separate diversion, it will mix with the fluid flow in the annulus 40 of the production casing 18. To effect the connection and diversion of flow from the production pipe, the casing plug 31 is provided with a two piece cross plug 45 threadably inserted in a tapped cross hole 46 extending through the main casing plug 31. The cross plug includes a sleeve 47 having a length just slightly smaller than the diameter of the casing plug 31 so that it may be positioned completely within the plug while the hole 28 is being cut and until the plug is in its final axial position. The outside of the sleeve 47 includes a main thread pattern along most of its length corresponding to the tapped threads in the cross hole 46. The lower end of the sleeve 47 is provided with a short section of tapping threads 50 sized to provide a self-tapping connection with the open severed end 41 of the production pipe held below the plug. The upper end of the sleeve 47 is provided with an internal threaded pattern 51 to receive a threaded closure plug 52. The interface between the closure plug and the sleeve may be sealed with a suitable O-ring 53. The closure plug 52 is in place in the sleeve 47 when the main casing plug 31 is initially positioned to halt the flow of well fluids at the wellhead. After the fire at the wellhead has been extinguished and before the wellhead repairs have been completed, the apparatus of the present invention may be operated to separately divert the flows from the production casing and the production pipe in the following manner.

The production casing 18 is cut off just above the upper end of the saddle 21 to form an upper casing end 54. A flanged mounting ring 55 is slipped over the upper casing end 54 with its cylindrical end engaging the upper end of the saddle. Attachment between the ring 55 and the saddle 21 may be effected by suitable circumferential weld 56. The attachment may be further secured with a second circumferential weld 57 between the ID of the ring 55 and the upper end 54 of the casing 18. The mounting flange 58 on the upper end of the mounting ring 55 may be utilized to mount a suitable valve and valve operator (not shown) to control flow diverted from the production pipe 20, as will be described. The mounting ring 55 may also be used to carry an operating tool mechanism 60 which is utilized to provide the tapped threaded connection between the sleeve 47 and the severed end 41 of the production pipe and to withdraw the closure plug 52 after the connection has been made. The upper end of the sleeve 47 is provided with a pair of diametrically opposite notches 61 for receipt of the lugs 62 on part of the operating tool 60 functioning as a spanner wrench. With the main casing plug 31 positioned centrally within the production casing and rotated to align the cross hole 46 with a production pipe 20, the operating tool 60 is moved axially to engage the threaded sleeve 47 and to rotate the same causing the tapping threads 50 on the opposite end to move radially out of the plug 31 and to tap into the severed end 41 of the production pipe. After the connection between the sleeve 47 and the production pipe 20 has been completed, an axial driver 64 (which may be caused to extend axially beyond the spanner lugs 62 or inserted on the end of a separate tool shaft after removal of the spanner tool 60) is caused to engage a recess 63 in the closure plug 52 to cause the plug to be withdrawn from the sleeve, thereby opening the ID of the sleeve to the flow therethrough of fluid from the production pipe 20. In this manner, the flow of oil or other fluid from the production pipe 20 may be separately and independently controlled while wellhead repairs are completed. Simultaneously and as previously described, flow from the production casing 18 may likewise be separately controlled via the valve mechanism attached to the outlet passage 44 in the receiving chamber 33.

When the repairs at the wellhead 12 have been completed, the separately diverted flows are shut off, the threaded closure plug 52 is replaced in the sleeve 47, the tapped connection 50 is disconnected from the end of the production pipe 20 by withdrawing the sleeve 47 into the casing plug 31, and the plug 31 is rotated by the operating mechanism 38 approximately 90° to cutoff flow into the first fluid inlet from the production casing annulus 40. The casing plug 31 and attached drill 30 are withdrawn axially into the access chamber 32, leaving the interior of the production casing 18 fully accessible from the repaired wellhead for permanent reconnection of the severed production pipe 20 using known methods and apparatus. The entire operating mechanism 38, including the drill 30 and plug 31, may be removed from the saddle 21 for use on another well. The access chamber 32 may be permanently sealed or provided with a valve mechanism, as desired.

Figure 8:
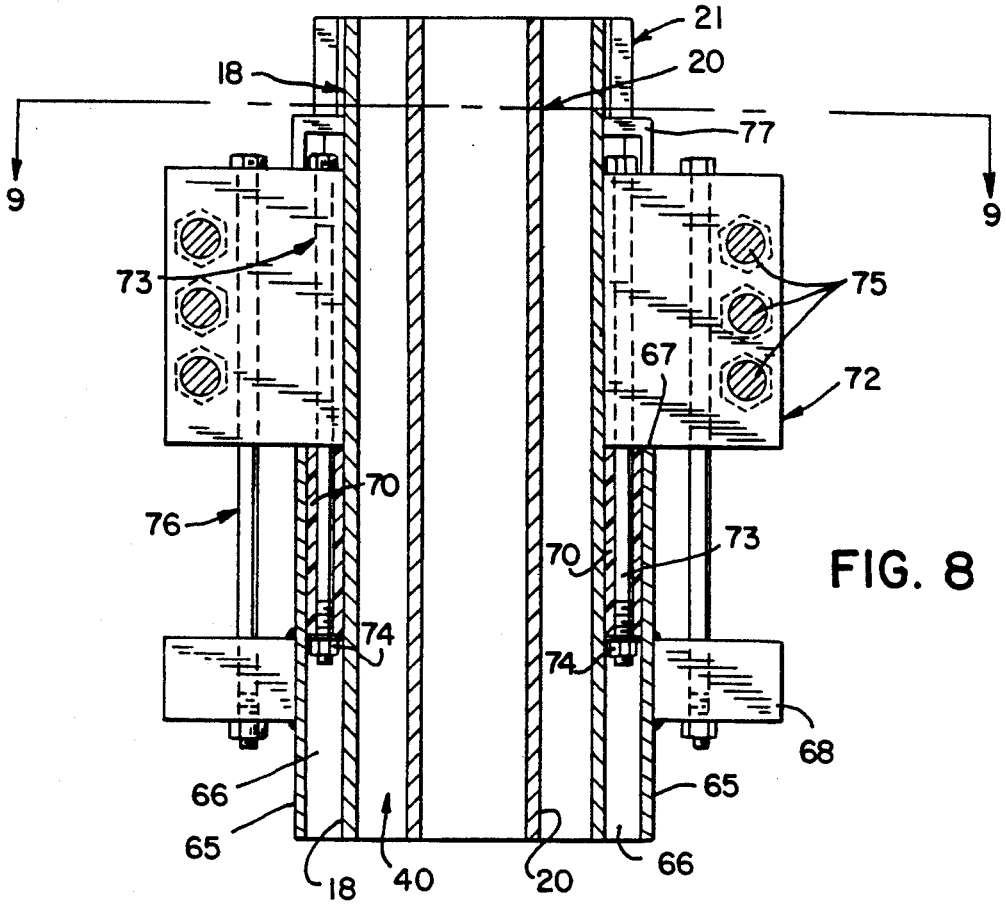
FIG. 8 is a vertical section through a supplemental positioning and sealing apparatus used with the present invention.
Figure 9:
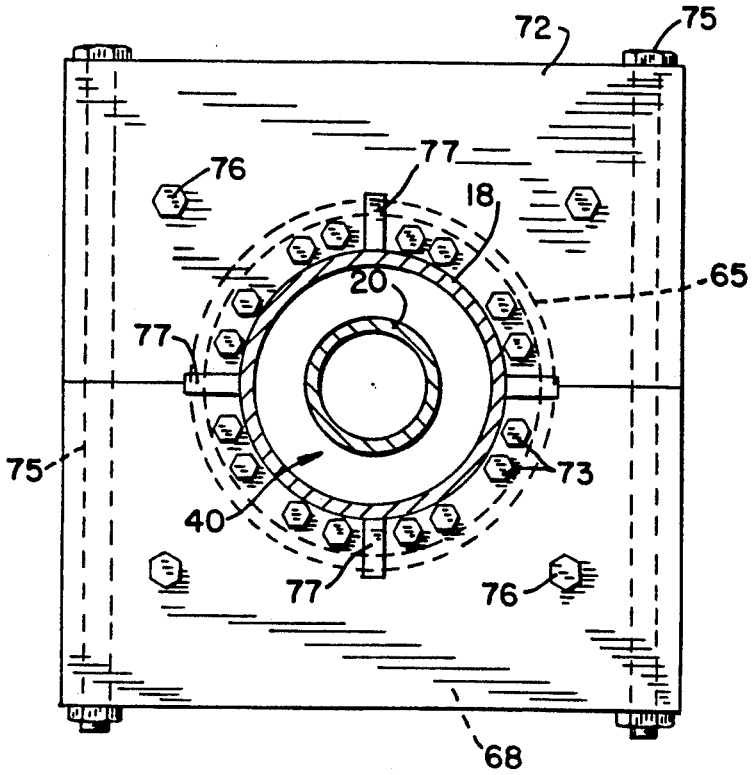
FIG. 9 is a horizontal section taken on line 9—9 of FIG. 8.

Referring now to FIGS. 8 and 9, in the construction of some wells, the production casing 18 is surrounded by an intermediate casing 65 which is unlined such that an open outer annulus 66 exists between the production casing and the intermediate casing. This annulus may contain gas, oil, or other well fluids as a result of downhole leakage and, therefore, it may be necessary to provide means to seal the outer annulus 66 so that any fluids therein will not interfere with the plugging and reopening operations to be subsequently undertaken. In a typical well construction, the intermediate casing 65 may have an OD of 9⅝th inches (24.4 cm), the production casing 18 and OD of 7 inches (17.8 cm), and the production pipe 20 an OD of 3½ inches (8.9 cm).

After the outer layers and linings of the main casing 11 have been cut away to the surface of the intermediate casing 65 but before attachment of the saddle 21, the upper section of the intermediate casing is cut away leaving a casing upper end 67 and an open outer annulus 66. A two piece split ring 68 is placed around the intermediate casing 65 below the upper end 67 and welded thereto to completely surround the casing. A large split mounting block 72 is placed around the exposed production casing 18 immediately above the intermediate casing end 67. An annular elastomer ring 70 is attached to depend downwardly from the underside of the mounting block 72 with a series of long mounting bolts 73 extending through the block 72 and elastomer ring 70 to attachment at the lower end thereof with suitable nut/backing washer combinations 74. The elastomer ring 70 is slid downwardly into the annulus 66 until the halves of the split mounting block 72 abut and rest on the upper end 67 of the intermediate casing 65. The mounting block is clamped together by a series of clamping bolts 75, but the ID of the mounting block does not clamp tightly around the production casing 18. A series of tie bolts 76 attaches the mounting block 72 to the split ring 68 and, as the bolts 73 are drawn tightly, the elastomer ring 70 will expand against the walls defining the annulus 66 to seal the same and to hold the production casing 18 against any axial movement relative to the intermediate casing 65.

A series of L-shaped stand-offs 77 are positioned on top of the mounting block 72 immediately adjacent the production casing 18. The upper faces of the stand-offs provide a supporting surface for the semicircular halves 22 of the saddle 21 which are subsequently attached, and also maintain a suitable spacing for access to the heads of the mounting bolts 73.

In an alternate embodiment of the interconnection to the severed production pipe 20 for diversion of the flow therein previously described with reference to FIG. 6, the flow from the production pipe could also be diverted axially of the main casing plug 31 in a manner similar to that provided via the first fluid passage 43, but in the opposite axial direction and into the access chamber 32. An alternate outlet passage 78, shown in FIG. 5, would be initially covered and closed by the closure plug 52 and sleeve 47. An appropriate cross hole would be required in the sleeve 47, which hole would be initially covered by the closure plug and aligned with the alternate outlet passage 78 when the tapped connection to the production pipe is completed. Then the closure plug 52 could be backed upwardly by the driver tool 64 to open the outlet passage, but without withdrawing the closure plug from the sleeve.

Various modes of carrying out the present invention are contemplated as being within the scope of the following claims particularly pointing out and distinctly claiming the subject matter which is regarded as the invention.

I claim:

1. An apparatus for plugging and reopening an oil well of the type having an outer production casing and an inner production pipe suspended inside the outer casing, both of which casings are carrying a flow of well fluids, and in which the outer casing has been enclosed in a cylindrical saddle and plugged with a plug positioned in a hole extending laterally therethrough to block the entire casing I.D., and the inner pipe has been severed with the lower section thereof held coaxially within said outer casing to define therewith an annulus, and the open severed end of the pipe section positioned below and adjacent the plug, said apparatus comprising:

a first fluid inlet in the outer surface of the plug aligned and in fluid communication with the annulus;

first fluid control means for directing fluid flowing into said first inlet from the annulus through the plug and saddle in a direction axially of the hole;

an initially plugged second fluid inlet in the plug surface including a diametral bore through the plug aligned axially with the severed end of the pipe section below the plug; and, second fluid flow control means operatively interconnecting said second inlet and said severed pipe end for opening said plugged second inlet and directing fluid from said inner pipe end through said plug.

2. The apparatus as set forth in claim 1 wherein said second fluid control means comprises:

a sleeve member having a threaded outer surface adapted to engage and to be threadably received in said through bore;

said sleeve having a threaded inner surface adapted to receive a threaded closure plug to provide said initially plugged second fluid inlet;

said sleeve having tapping threads formed in the end thereof adjacent the second fluid inlet; and, means for engaging the opposite end of said sleeve and for driving said sleeve downwardly to bring said tapping threads into tapped connection with the severed end of the pipe section; and, means for engaging said closure plug from said opposite sleeve end and for driving said closure plug upwardly to open said plugged second inlet.

3. An apparatus for plugging and reopening a flowing oil well of the type having an outer production casing and an inner production pipe suspended inside the outer casing, both of which casing and pipe are carrying a flow of well fluids, said apparatus comprising:

means for enclosing a section of the outer production casing in a cylindrical sleeve;

means attached to said sleeve and extendible through said outer casing for engaging, positioning and holding said inner pipe coaxially within said outer casing;

means operatively attached to said sleeve for movement diametrically through said sleeve, for cutting a diametral hole through said outer casing and for severing said inner pipe, said hole having a diameter at least as large as the I.D. of said outer casing;

plug means having an outer surface conforming to the size and shape of said diametral hole insertable into said hole for plugging said hole and halting fluid flow therepast from the outer casing and the inner pipe;

a first fluid inlet in the outer surface of said plug means aligned and in fluid communication with the annulus formed between the inside of said outer casing and the outside of said inner pipe;

first fluid flow control means for directing fluid flowing into said first inlet from said annulus through said plug means and sleeve in a direction axially of said hole;

a plugged second fluid inlet in the outer surface of said plug means aligned axially with the severed end of said inner pipe below said plug means and defining a through bore extending through said plug on the diameter thereof;

second fluid flow control means operatively interconnecting said second fluid inlet and said severed inner pipe end for opening said plugged inlet and directing fluid from said inner pipe end through said plug means.

4. The apparatus as set forth in claim 3 wherein said first and second fluid flow control means are independently operable to selectively reopen the production casing and the production pipe, respectively, to separate the fluids flowing therein.

5. The apparatus as set forth in claim 4 wherein said plug means comprises a plug body having a generally cylindrical outer surface; said second fluid inlet comprising a tubular sleeve threadably inserted in said through bore; said sleeve having a closure plug threadably inserted therein; said sleeve and closure plug initially disposed fully within the outer surface of the plug body; and, wherein said second fluid flow control means comprises means for engaging said sleeve from above the plug, for driving the opposite end of said sleeve into threaded engaging connection with the severed end of said inner pipe, and for removing said closure plug after effecting said connection.

6. A method for selectively reopening an oil well casing of the type having an outer production casing and an inner production pipe suspended inside the outer casing, both of which casing and pipe are carrying a flow of well fluids, and in which the outer casing has been enclosed in a cylindrical saddle and temporarily plugged with a main plug extending laterally therethrough to completely block the inside diameter of the casing, and the inner pipe has been severed with the lower section thereof held coaxially within the outer casing to define therewith an annulus, and the open severed end of the pipe section positioned below and adjacent the plug, said method comprising the steps of:

(1) providing a first fluid inlet in the outer surface of the main plug;

(2) aligning said first fluid inlet with the annulus to provide fluid communication therebetween;

(3) directing well fluid flowing into said first inlet from the annulus through the plug and saddle in a direction generally axially of the hole;

(4) providing an initially plugged second fluid inlet in the outer surface of the plug, said second fluid inlet including a diametral bore through the plug;

(5) aligning said second fluid inlet and through bore axially with the severed end of the pipe section below the plug;

(6) interconnecting said second fluid inlet and said severed pipe end to isolate the well fluid therein from the well fluid flowing in said annulus; and, (7) opening said initially plugged second fluid inlet and directing the well fluid from said inner pipe and the bore through the plug.

7. The method as set forth in claim 6 wherein said aligning steps are performed simultaneously.

* * * * *